US009415609B2

(12) United States Patent
Shirota et al.

(10) Patent No.: US 9,415,609 B2
(45) Date of Patent: Aug. 16, 2016

(54) RECORDING APPARATUS WITH DISPLAY PANEL AND OPERATION PANEL

(71) Applicant: SEIKO EPSON CORPORATION, Tokyo (JP)

(72) Inventors: Kenichi Shirota, Suwa (JP); Atsuhiko Takeuchi, Matsumoto (JP); Narihiro Oki, Matsumoto (JP); Shinji Kanemaru, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/680,737

(22) Filed: Apr. 7, 2015

(65) Prior Publication Data

US 2015/0294195 A1 Oct. 15, 2015

(30) Foreign Application Priority Data

Apr. 14, 2014 (JP) ..... 2014-082552

(51) Int. Cl.

| | |
|---|---|
| ***B41J 2/175*** | (2006.01) |
| ***B41J 3/46*** | (2006.01) |
| ***B41J 3/36*** | (2006.01) |
| ***B41J 29/02*** | (2006.01) |
| ***B41J 29/13*** | (2006.01) |
| ***B41J 29/38*** | (2006.01) |

(52) U.S. Cl.
CPC .... *B41J 3/46* (2013.01); *B41J 3/36* (2013.01); *B41J 29/02* (2013.01); *B41J 29/13* (2013.01); *B41J 29/38* (2013.01)

(58) Field of Classification Search
None
See application file for complete search history.

(56) References Cited

U.S. PATENT DOCUMENTS 6,179,415 B1 * 1/2001 Okazaki ..... B41J 2/17513 347/49
6,814,436 B2 * 11/2004 Anami ..... B41J 13/0063 347/101

FOREIGN PATENT DOCUMENTS

JP 2009-075516 4/2009
JP 2013-193346 9/2013

* cited by examiner

*Primary Examiner* — Paul F Payer
(74) *Attorney, Agent, or Firm* — Workman Nydegger

(57) ABSTRACT

A recording apparatus includes a recording head that performs recording on a medium, a carriage that reciprocates in a predetermined direction, and an operation panel that has a predetermined operation function. The carriage and the operation panel are adjacent to each other. The operation panel overlaps at least a portion of the carriage in a height direction of the recording apparatus.

20 Claims, 11 Drawing Sheets

RECORDING APPARATUS WITH DISPLAY PANEL AND OPERATION PANEL

BACKGROUND

1. Technical Field

The present invention relates to a recording apparatus.

2. Related Art

In recent years, as a recording apparatus such as an ink jet recording apparatus, a compact recording apparatus which is portable outdoors has become popular in addition to a stationary recording apparatus which is used indoors. There is a demand for a compact and very portable recording apparatus in order to carry a recording apparatus put in a bag. Accordingly, a miniaturizing method thereof has been studied.

For example, an operation panel having operation buttons arranged thereon or a liquid crystal display (hereinafter, referred to as an LCD in some cases) for displaying various information items such as menus and errors is configured to adopt a so-called tilt type which can be operated by changing an angle thereof. In a case where the operation panel or the LCD is disposed on an upper surface portion of the recording apparatus, when not in use, the operation panel or the LCD is folded down so as to be integrated with the upper surface. When in use, the operation panel or the LCD is lifted up so as to allow an angle for good operability and visibility. In this manner, the recording apparatus has been miniaturized, and portability thereof has been improved.

JP-A-2013-193346 discloses a printing apparatus in which a display panel 21 is arranged on an upper surface of a printing apparatus 10 so that a tilting angle thereof is changed with respect to the upper surface. When in use, the display panel 21 can be lifted up. When not in use, the display panel 21 can be tilted so as to overlap the upper surface at the same angle.

In an ink jet printer 50 disclosed in JP-A-2009-75516, a liquid crystal display 10 of a tilt type is arranged at a position where the liquid crystal display 10 does not overlap a feeding opening 2 for receiving a recording sheet P.

Here, a supply port 53 for supplying a printing sheet 50 is disposed on the upper surface of the printing apparatus 10 disclosed in JP-A-2013-193346. If the display panel 21 is tilted so as to overlap the upper surface at the same angle, the display panel 21 closes the supply port 53.

Consequently, when a printing sheet 50 is supplied to the supply port 53, that is, when the printing apparatus 10 is used, it is necessary to use the printing apparatus 10 after lifting up the display panel 21.

A printing apparatus which can perform printing on printing sheets having multiple sizes is configured so that a sheet guide for guiding a lateral edge in a width direction of the printing sheets into the supply port is provided, and a user can move the sheet guide depending on the size of the printing sheet. In this case, if the display panel is lifted up, the inside of the supply port is hardly visible when the display panel is viewed from the front. When the user moves the sheet guide, the user needs to operate the printing apparatus by looking into the supply port located on the rear side of the display panel.

On the other hand, as disclosed in JP-A-2009-75516, if the liquid crystal display 10 is arranged so as not to overlap the feeding opening 2, the sheet guide is caused to have better operability which is required for the printing apparatus disclosed in JP-A-2013-193346. However, the liquid crystal display 10 is arranged so as not to completely overlap the feeding opening 2. Consequently, a size of the apparatus further increases in a depth direction (axial direction of an arrow Y in FIG. 1 of JP-A-2009-75516), as compared to the printing apparatus disclosed in JP-A-2013-193346 in which the display panel completely closes the supply port.

SUMMARY

An advantage of some aspects of the invention is to provide a recording apparatus which includes a panel unit such as a liquid crystal display or an operation panel, which has excellent operability when a sheet guide is used, and which is compact and portable.

According to an aspect of the invention, there is provided a recording apparatus including a carriage that includes a recording head which performs recording on a medium, and that reciprocates in a predetermined direction, and a panel unit that has a predetermined display function. The carriage and the panel unit are adjacent to each other, and the panel unit overlaps at least a portion of the carriage in a height direction of the recording apparatus.

In this case, it is possible to decrease a possibility that the overall apparatus may increase in size in the height direction. A portion of an opening of a medium setting unit and the panel unit overlap each other. Therefore, the panel unit can be arranged by further saving an arrangement space, thereby enabling the recording apparatus to be miniaturized.

In addition, a first edge guide unit is movable in a region where the panel unit and the opening do not overlap each other. Therefore, there is no possibility that operability may be degraded when the first edge guide unit is moved by the panel unit.

The "region" of "the region where the panel unit and the opening do not overlap each other" means a region where the first edge guide unit can be disposed at a position in which the panel unit does not interfere with a movement operation of the first edge guide unit. The meaning does not require a strict boundary position of the "region".

In the recording apparatus, at least a portion of the carriage may overlap the panel unit in a depth direction from a front surface side to a rear surface side of the recording apparatus.

In this case, it is possible to decrease a possibility that the overall apparatus may increase in size in the depth direction. The panel unit has a tilted surface opposing a placement surface. Accordingly, the placement surface and a rear surface of the panel unit opposing the placement surface can be arranged substantially in parallel with each other. Therefore, it is possible to easily secure a space for setting the medium between the placement surface and the panel unit.

The recording apparatus may further include a stepped portion that is formed in the carriage. The stepped portion and the display panel may be adjacent to each other, and the panel unit may overlap the stepped portion in at least any one direction of the height direction of the recording apparatus and the depth direction from the front surface side to the rear surface side of the recording apparatus.

In this case, it is possible to decrease a possibility that the overall apparatus may increase in size in the height direction, or a possibility that the overall apparatus may increase in size in the depth direction. The medium can be stably supplied to the recording apparatus by causing a first opening/closing unit in an open state to support the medium set by the medium setting unit.

The recording apparatus may further include a medium setting unit that has an opening into which a transported medium is inserted, and a first edge guide unit that guides an edge portion of the medium set by the medium setting unit. The first edge guide unit may be movable in a region where the panel unit and the opening do not overlap each other.

In this case, a portion of the opening of the medium setting unit and the panel unit are disposed so as to overlap each other. Therefore, the panel unit can be arranged by further saving an arrangement space, thereby enabling the recording apparatus to be miniaturized.

In addition, the first edge guide unit is movable in a region where the panel unit and the opening do not overlap each other. Therefore, there is no possibility that operability may be degraded when the first edge guide unit is moved by the panel unit.

The "region" of "the region where the panel unit and the opening do not overlap each other" means a region where the first edge guide unit can be disposed at a position in which the panel unit does not interfere with a movement operation of the first edge guide unit. The meaning does not require a strict boundary position of the "region". According to the recording apparatus including a liquid crystal display configured to be tiltable as the panel unit, in a state where the liquid crystal display is retracted, it is possible to obtain an operation effect which is the same as that in the above-described aspect.

A position where the liquid crystal display configured to be tiltable overlaps the opening is an outside region of the operation region of the first edge guide unit. Therefore, this decreases a possibility that the first edge guide unit may be hardly visible in a state where the liquid crystal display is lifted up.

In the recording apparatus, the panel unit may have a tilted surface opposing a placement surface on which the medium is placed in the medium setting unit.

In this case, the panel unit has the tilted surface opposing the placement surface. Accordingly, the placement surface and a rear surface of the panel unit opposing the placement surface can be arranged substantially in parallel with each other. Therefore, it is possible to easily secure a space for setting the medium between the placement surface and the panel unit.

The recording apparatus may further include a first opening/closing unit that opens and closes the opening of at least the medium setting unit, and that supports the medium set by the medium setting unit in an open state. A medium support surface of the first opening/closing unit in the open state extends along a tilt of the tilted surface of the panel unit.

In this case, the medium can be stably supplied to the recording apparatus by causing the first opening/closing unit in an open state to support the medium set by the medium setting unit. It is possible to decrease a possibility that the overall apparatus may increase in size in the height direction.

In the recording apparatus, a roll-shaped medium may be fed to the opening in a state where the panel unit overlaps the opening.

In this case, it is possible to obtain an operation effect which is the same as that in the above-described aspect. Accordingly, it is possible to provide the recording apparatus which can perform recording on a rolled sheet.

The recording apparatus may further include a second edge guide unit on a side which opposes the first edge guide unit. The first edge guide unit may be disposed on the right side when viewed from a downstream side in a transport direction of the medium, and a distance between both of the edge guide units may be changed by operating the first edge guide unit.

"Downstream" in the description represents a direction in which the recording medium is transported in the recording apparatus. A direction opposite to downstream is referred to as "upstream".

A portable and compact recording apparatus is configured so that the medium such as a recording sheet is set on the rear side when the recording apparatus is viewed from the front and the recording medium after recording is discharged from the front side of the recording apparatus.

In this case, a user operates the first edge guide unit disposed on the right side when the recording apparatus is viewed from the front, thereby enabling the user to change the distance between both of the edge guide units. In this manner, it is possible to adopt a configuration in which a right-handed user is likely to operate the apparatus.

In the recording apparatus, the second edge guide unit may be formed to be smaller than the first edge guide unit.

The first edge guide unit on the right side is formed to have a size which allows a user to easily operate the first edge guide unit with the user's hand. On the other hand, the second edge guide unit is not operated by the user, and thus may have a size needed to guide the medium. Therefore, the second edge guide unit can be formed to be smaller than the first edge guide unit.

Here, the second edge guide unit is located on the side opposing the first edge guide unit, and is located in the outside region of the operation region of the first edge guide unit. Therefore, in some cases, the second edge guide unit is located below the panel unit which overlaps a portion of the opening.

In this case, it is possible to configure the second edge guide unit so as not to interfere with the panel unit by forming the second edge guide unit to be smaller than the first edge guide unit. A user is less likely to operate a second edge guide unit whose size is small. Therefore, it is possible to minimize a possibility that the user may erroneously operate the second edge guide unit.

The recording apparatus may further include the carriage that includes the recording head which performs recording on the medium, and that reciprocates in the predetermined direction, and a second opening/closing unit that opens and closes a reciprocating movement region of the carriage. The panel unit and the second opening/closing unit are arranged so as to be connected to each other in the depth direction of the recording apparatus.

In this case, it is possible to decrease a possibility that the overall apparatus may increase in size in the depth direction.

BRIEF DESCRIPTION OF THE DRAWINGS

The invention will be described with reference to the accompanying drawings, wherein like numbers reference like elements.

FIG. 6A illustrates a state where both of the edge guide units are positioned on the outermost side, FIG. 6B illustrates a state where the second edge guide unit is positioned on the innermost side, and FIG. 6C illustrates a state where the first edge guide unit is positioned on the innermost side.

FIG. 7A illustrates a state where a liquid crystal display is retracted, and FIG. 7B illustrates a state where the liquid crystal display is lifted up.

DESCRIPTION OF EXEMPLARY EMBODIMENTS

Hereinafter, a recording apparatus according to embodiments of the invention will be described with reference to the accompanying drawings. The invention is not limited to the embodiments.

Embodiment 1

Figure 1:
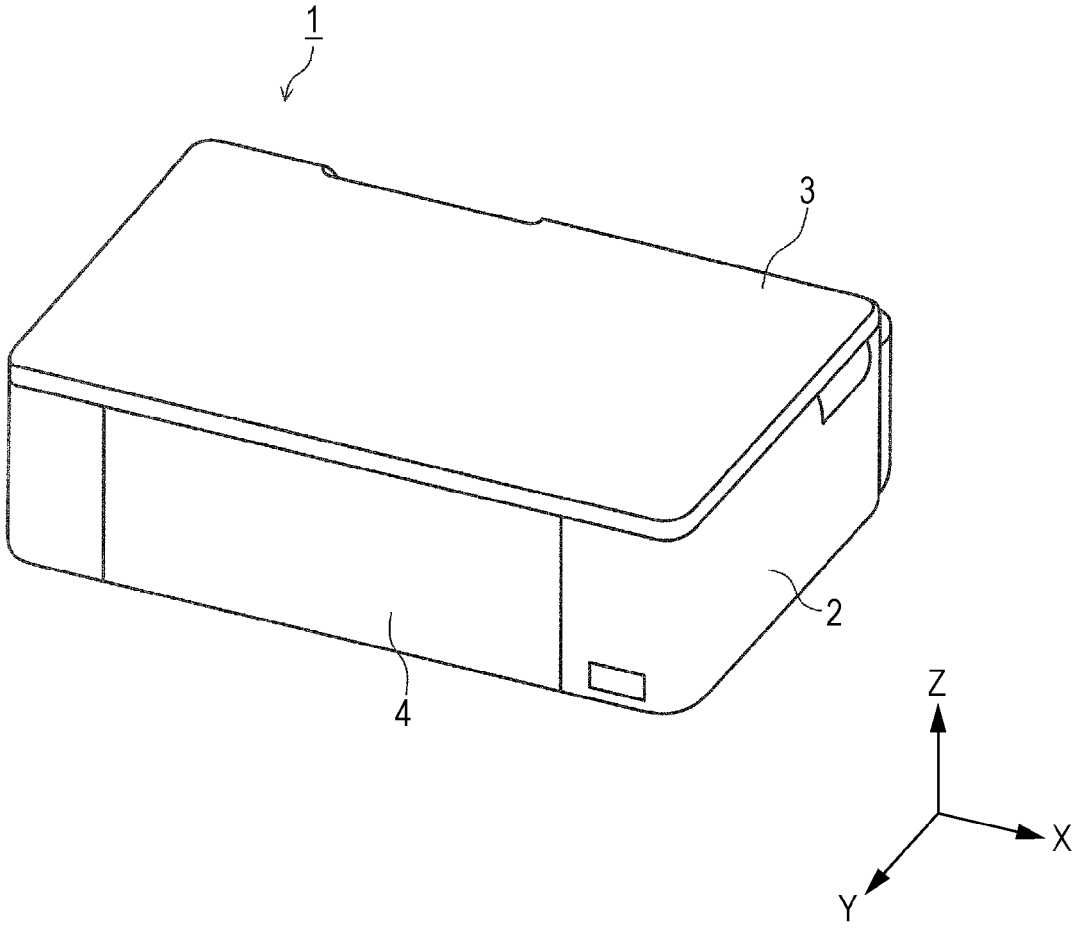
FIG. 1 is a perspective view illustrating a recording apparatus according to an embodiment of the invention.
Figure 2:
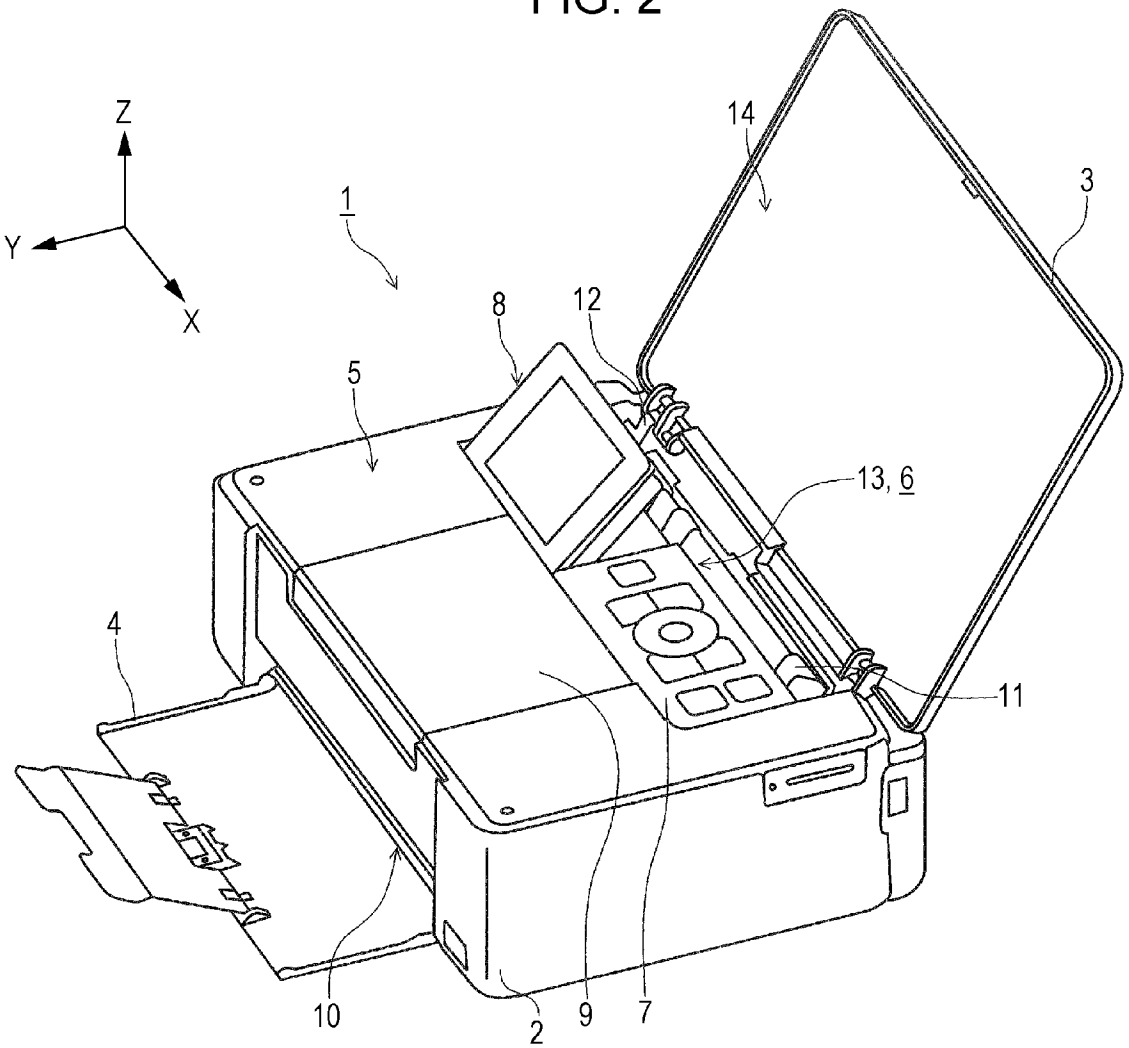
FIG. 2 is a perspective view illustrating a state where an upper surface cover and a sheet discharge cover are open in the recording apparatus illustrated in FIG. 1.
Figure 3:
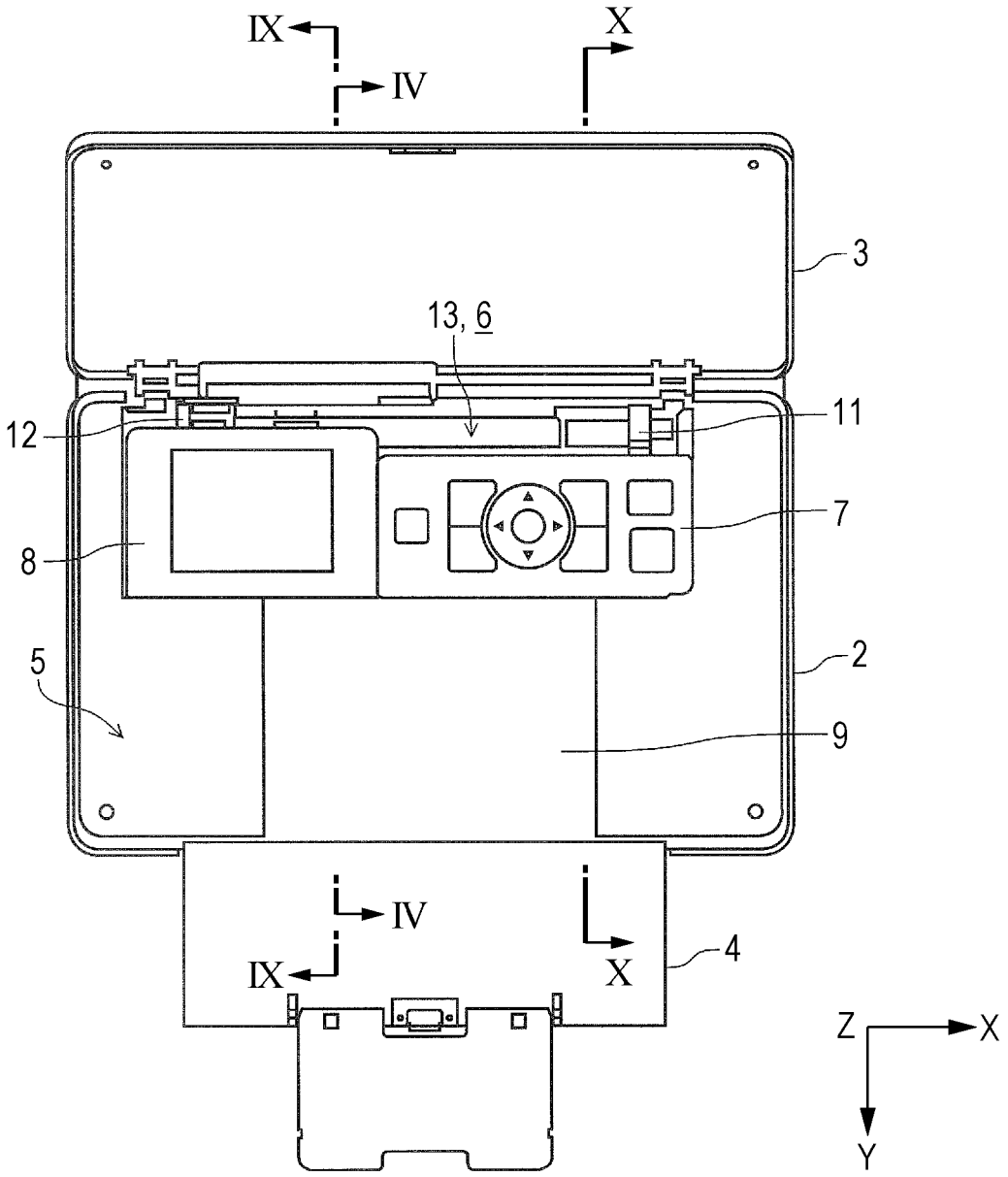
FIG. 3 is a top view of the recording apparatus illustrated in FIG. 2.
Figure 4:
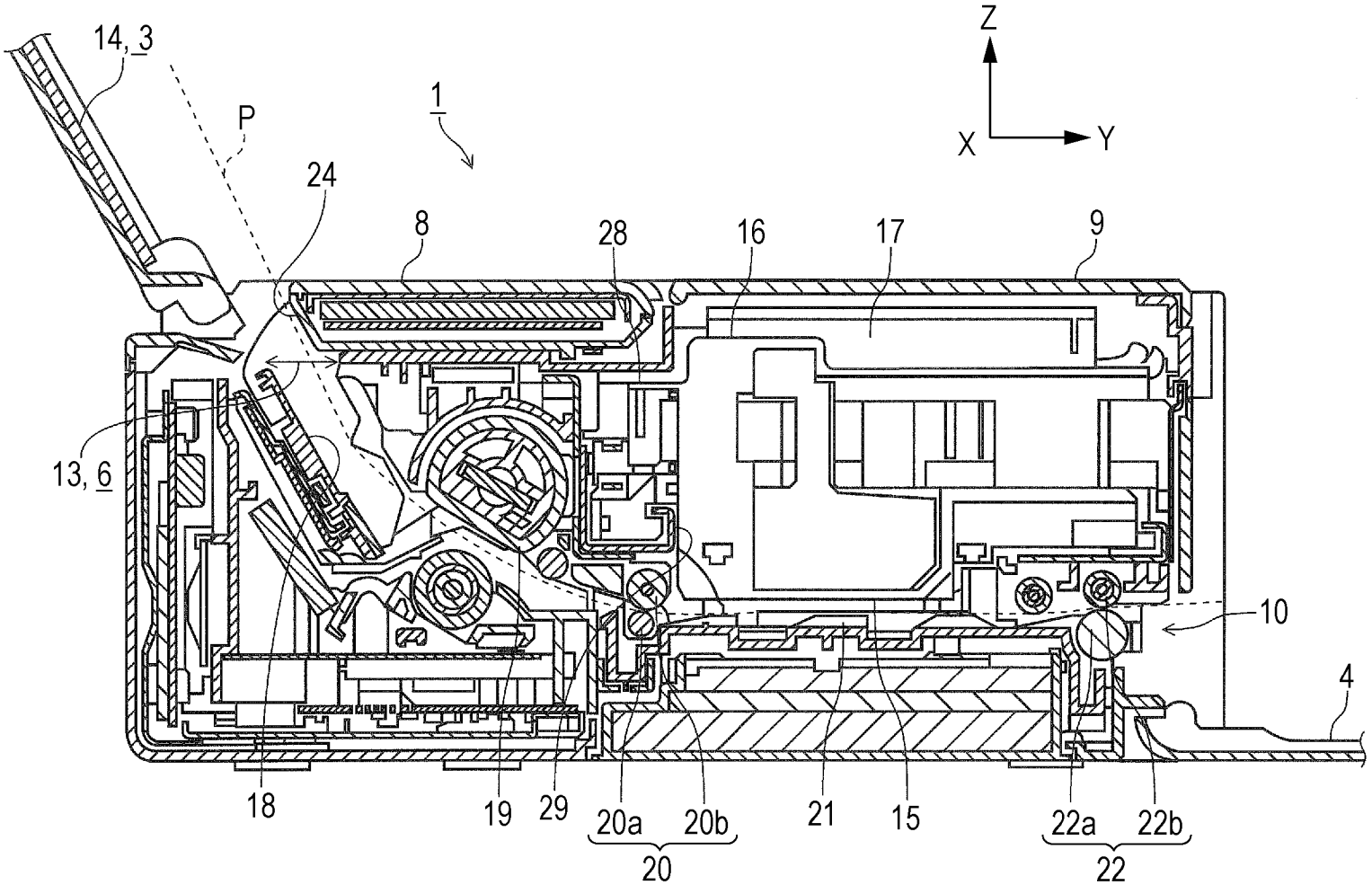
FIG. 4 is a cross-sectional view taken along arrow line IV-IV of the recording apparatus illustrated in FIG. 3.
Figure 5:
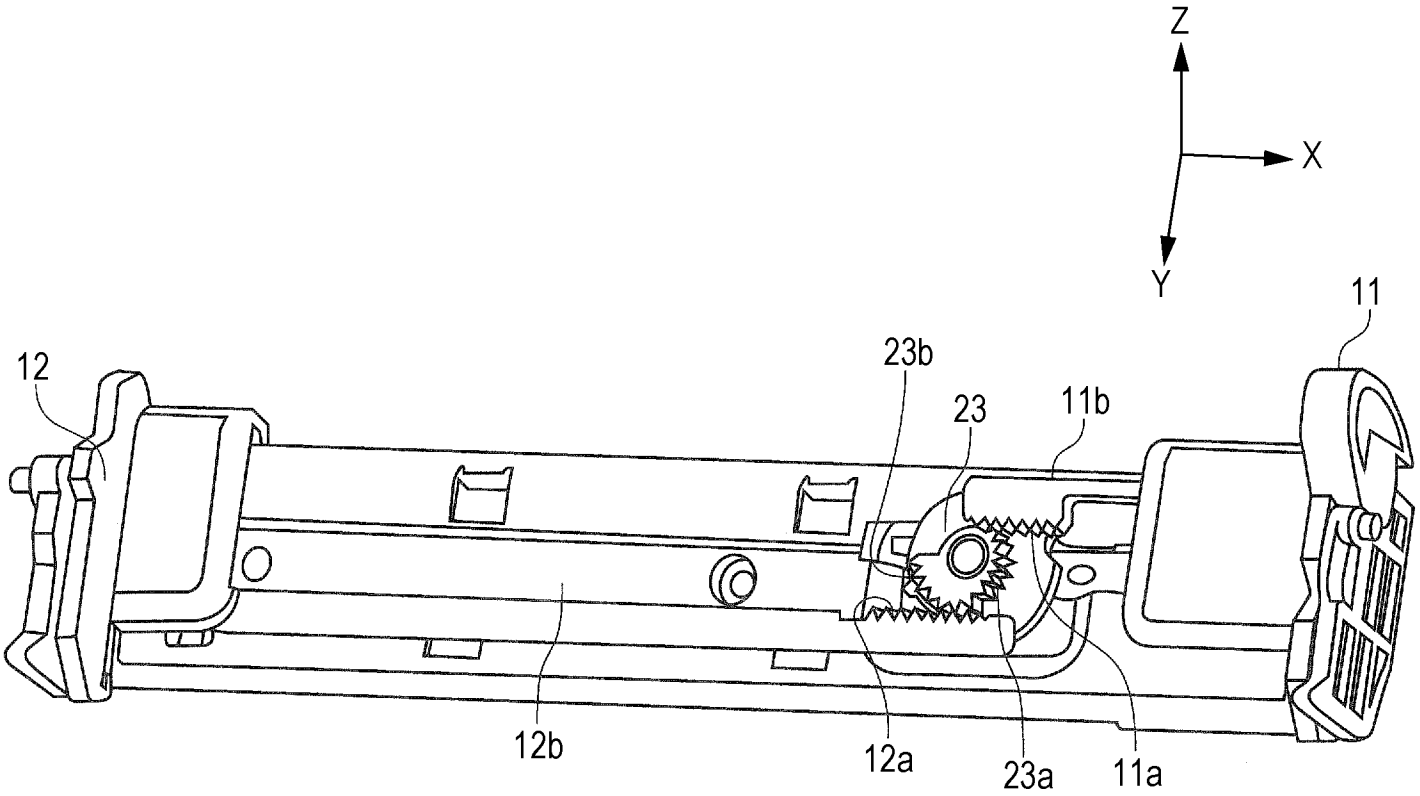
FIG. 5 is a main part enlarged view illustrating a medium guide unit, and first and second edge guide units in the recording apparatus according to the embodiment of the invention.
Figure 6A:
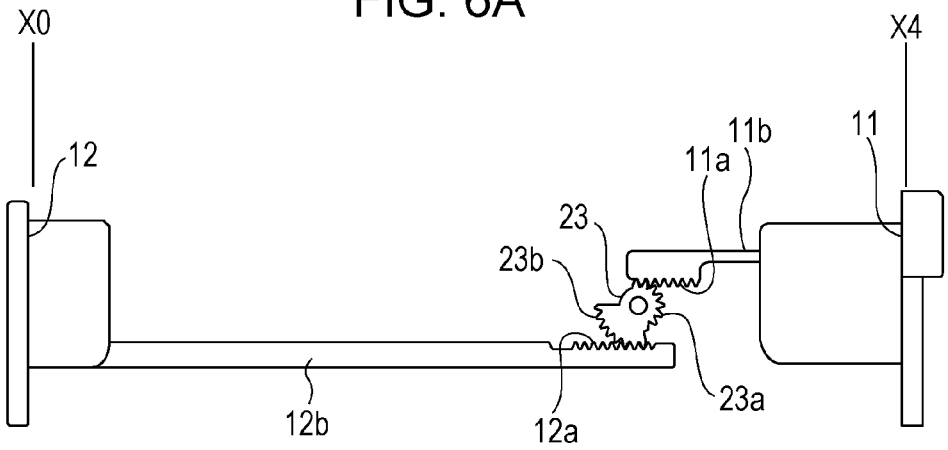
FIGS. 6A to 6C are views for illustrating a movement mechanism of the first edge guide unit and the second edge guide unit.
Figure 6B:
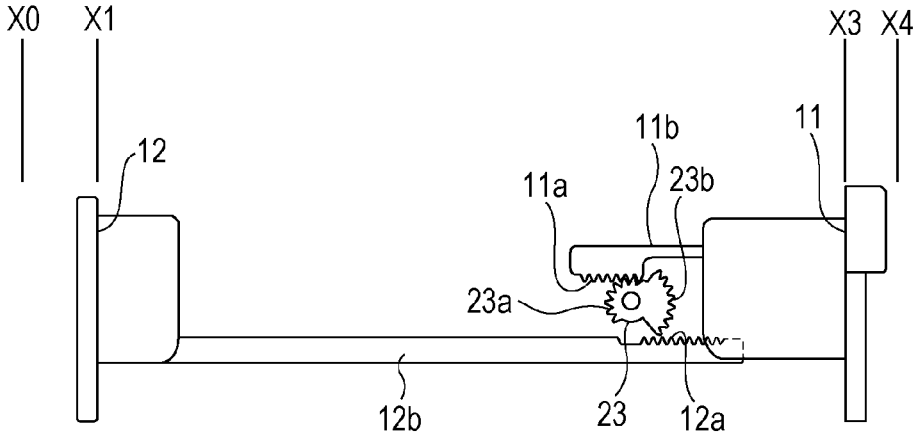
Figure 6C:
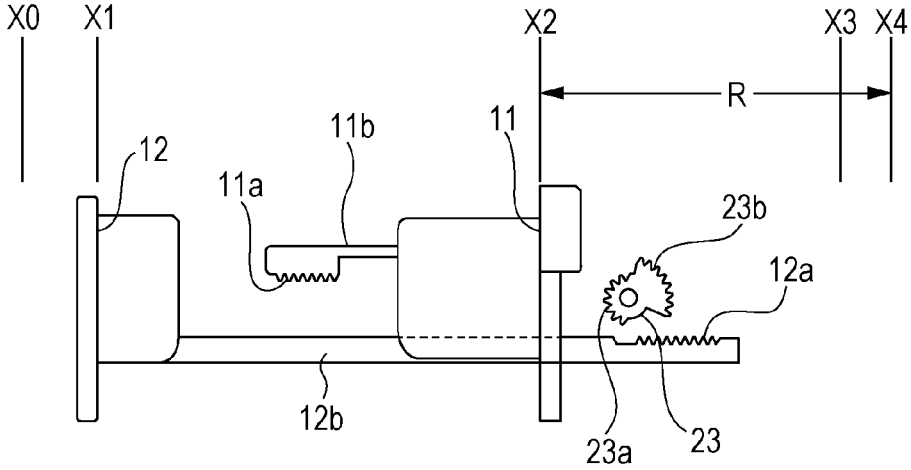

First, an overview of a recording apparatus 1 according to an embodiment of the invention will be described. As an example of the recording apparatus 1 according to the present embodiment, an ink jet recording apparatus will be described. FIG. 1 is a perspective view illustrating the recording apparatus 1 according to the embodiment of the invention. FIG. 2 is a perspective view illustrating a state where an upper surface cover 3 and a sheet discharge cover 4 are open in the recording apparatus illustrated in FIG. 1. FIG. 3 is a top view of FIG. 2. FIG. 4 is a cross-sectional view taken along arrow line IV-IV of the recording apparatus illustrated in FIG. 3. FIG. 5 is a main part enlarged view illustrating a medium guide unit, and an edge guide unit in the recording apparatus according to the embodiment of the invention. FIGS. 6A to 6C are views for illustrating a movement mechanism of a first edge guide unit and a second edge guide unit. FIG. 6A illustrates a state where both of the edge guide units are positioned on the outermost side, FIG. 6B illustrates a state where the second edge guide unit is positioned on the innermost side, and FIG. 6C illustrates a state where the first edge guide unit is positioned on the innermost side.

As illustrated in FIG. 1, the recording apparatus 1 is configured to externally include a main body 2 of the recording apparatus 1, an upper surface cover 3 covering an upper surface section 5 (refer to FIG. 2) of the main body 2, and a sheet discharge cover 4 disposed on a front surface side (side surface in the +Y direction) of the main body 2 in FIG. 1.

The −Z direction of a Z-axis illustrated in each drawing represents a gravity direction. A side in the gravity direction is referred to as downward (including a lower part and a lower surface), and the opposite side is referred to as upward (including an upper part and an upper surface).

As illustrated in FIGS. 2 and 3, in the recording apparatus 1, the upper surface section 5 has a medium setting unit 6 having an opening 13 into which a medium P (refer to FIG. 4) such as a recording sheet is inserted. In the embodiment, the upper surface cover 3 represents a first opening/closing unit which opens and closes the upper surface section 5 including the opening 13 of the medium setting unit 6. In addition, the upper surface cover 3 in an open state is configured so that the medium P set by the medium setting unit 6 is supported by a support surface 14.

Next, a schematic internal structure of the recording apparatus 1 will be described with reference to FIG. 4 by following a transport route of the medium P.

The recording apparatus 1 is configured so that the recording medium P is transported in the +Y direction in FIG. 4. Hereinafter, a direction in which the medium P is transported in the recording apparatus 1 is referred to as "downstream", and the opposite direction is referred to as "upstream" in some cases.

The main body 2 internally has a carriage 16 including a recording head 15 which performs recording by ejecting a liquid onto the medium P. The carriage 16 is disposed so as to reciprocate in a direction (X-axis direction) intersecting a transport direction (+Y direction) of the medium P. The carriage 16 is equipped with a liquid container 17 for supplying the liquid (for example, an ink) to the recording head 15 in order to perform recording on the medium P.

A stepped portion 28 in a direction from above to below is disposed in the −Y direction of the carriage 16. A frame 29 which slides on the carriage 16 during reciprocating movement is disposed inside the main body 2 below the stepped portion 28.

The medium P is inserted through the opening 13, is placed on a placement surface 18, and is set by the medium setting unit 6. The medium P set by the medium setting unit 6 is picked up by a sheet feeding roller 19 units by units, and is fed downstream in the transport direction.

The medium P fed from the upstream side in the transport direction is pinched by transport rollers 20 configured to include a transport driving roller 20*a* and a transport driven roller 20*b* in pressurizing contact with the transport driving roller 20*a*. In this state, the medium P is transported to a recording position below the recording head 15 (−Z direction).

A platen 21 which opposes the recording head 15 and regulates a gap between a liquid ejecting surface of the recording head 15 and the medium P is disposed below the recording head 15. Recording is performed on the medium P by ejecting the liquid (ink) onto the medium P through the recording head 15, between the recording head 15 and the platen 21.

The medium P subjected to the recording is fed by a discharge roller 22 configured to include a discharge driving roller 22*a* disposed downstream in the transport direction in the recording head 15 and a driven roller 22*b*. The medium P is configured to be discharged from a medium discharge unit 10 and to be placed on a sheet discharge cover 4.

The medium setting unit 6 includes a first edge guide unit 11 and a second edge guide unit 12 which guide both side edges in a width direction (X-axis direction in the drawing) of the medium P set by the medium setting unit 6. In the embodiment, the first edge guide unit 11 is disposed so as to be slidingly movable in the X-axis direction by a user's operation depending on a size of the medium P.

On the other hand, the second edge guide unit 12 is not disposed on the assumption of the user's operation. Specifically, the second edge guide unit 12 is disposed so as to be slidingly movable in synchronization with the first edge guide unit 11 by a rack pinion mechanism illustrated in FIGS. 6A to 6C.

The first edge guide unit 11 has an arm portion 11*b* extending toward the second edge guide unit 12, and a rack portion 11*a* is formed in a distal end thereof. Similarly, the second edge guide unit 12 has an arm portion 12*b* extending toward the first edge guide unit 11, and a rack portion 12*a* is formed in a distal end thereof.

A pinion 23 is rotatably disposed between the rack portion 11*a* and the rack portion 12*a*. The reference numeral 23*a* represents a first gear portion meshing with the rack portion 11*a* in the pinion 23, and the reference numeral 23*b* represents a second gear portion meshing with the rack portion 12*a* in the pinion 23, respectively.

The second edge guide unit 12 is disposed so as to be slidingly movable in the width direction of the medium P in synchronization with the first edge guide unit 11 as described above, and friction resistance is applied to the sliding by friction means (not illustrated). In addition, friction resistance is also applied to the rotation of the pinion 23 by friction means (not illustrated).

FIG. 6A illustrates a state where both of the edge guide units of the first edge guide unit 11 and the second edge guide unit 12 are positioned on the outermost side. This state corresponds to the medium P having the maximum recordable width size in the recording apparatus 1. In this state, the rack portions 11*a* and 12*a* respectively mesh with the pinion 23. In this case, a position of the first edge guide unit 11 is represented by X4, and a position of the second edge guide unit 12 is represented by X0.

In this state, if the first edge guide unit 11 is slidingly moved in the leftward direction in the drawing (direction of moving closer to the second edge guide unit 12) depending on the width size of the medium P, the rack pinion mechanism is actuated. The second edge guide unit 12 is synchronized with the first edge guide unit 11, and is displaced in a direction of moving closer to the first edge guide unit 11 (rightward direction in the drawing).

However, the rack portions 11*a* and 12*a* are respectively formed in only a portion of the arm portions 11*b* and 12*b*. Accordingly, if the first edge guide unit 11 is slid by a predetermined amount, the rack portions 11*a* and 12*a* respectively finish meshing with the pinion 23 as illustrated in FIG. 6B. That is, in this state, even if the first edge guide unit 11 is moved further in the direction of moving closer to the second edge guide unit 12 (leftward direction in the drawing), the second edge guide unit 12 is not slidingly moved in synchronization therewith. Therefore, FIG. 6B illustrates a state where the second edge guide unit 12 is located on the innermost side. When the first edge guide unit 11 is moved to the position of X3, the second edge guide unit 12 is moved to the position of X1.

On the other hand, even after finishing the mesh with the pinion 23, the first edge guide unit 11 can be moved further in the direction of moving closer to the second edge guide unit 12 (leftward direction in the drawing). The first edge guide unit 11 is configured to be movable to a position where a distance between both of the edge guide units becomes a distance corresponding to the medium P having the minimum recordable size in the recording apparatus 1. Then, the movement of the first edge guide unit is regulated by a regulation unit (not illustrated) so as not to further move from the position to the second edge guide unit 12. FIG. 6C illustrates a state where the first edge guide unit 11 is located on the innermost side. In this case, the position of the first edge guide unit 11 is represented by X2.

For example, the first edge guide unit 11 is movable from the position of X4 to the position of X2 by a user operating the first edge guide unit 11 with the user's hand. Hereinafter, a region between X4 and X2 in this case is referred to as an operation region R. In addition, an "outside region of the operation region R" is referred to as a region between X0 and X2.

In a configuration employing the above-described rack pinion mechanism, the second edge guide unit 12 itself is not directly operated by the user. Accordingly, a movement region (between X0 and X1) of the second edge guide unit 12 is not included in the "operation region R". In addition, the meaning does not require a strict boundary position of the "operation region R".

The embodiment is configured to change a movement amount of the first edge guide unit 11 and the second edge guide unit 12 by using a difference between a tooth shape of the first gear portion meshing with the rack portion 11*a* in the pinion 23 and a tooth shape of the second gear portion meshing with the rack portion 12*a*. Specifically, a configuration is adopted in which the movement amount of the second edge guide unit 12 is larger than the movement amount of the first edge guide unit 11.

A configuration is adopted in which edgeless recording which is recording without leaving a margin in an edge portion of the medium P is not performed on the medium P having the maximum recordable width size in the recording apparatus 1 (for example, width size of X0 to X4 in FIG. 6A), and in which edgeless recording may be performed on a medium P having a size smaller than the maximum width size (for example, equal to or smaller than the width size of X1 to X3 in FIG. 6B).

Figure 7B:
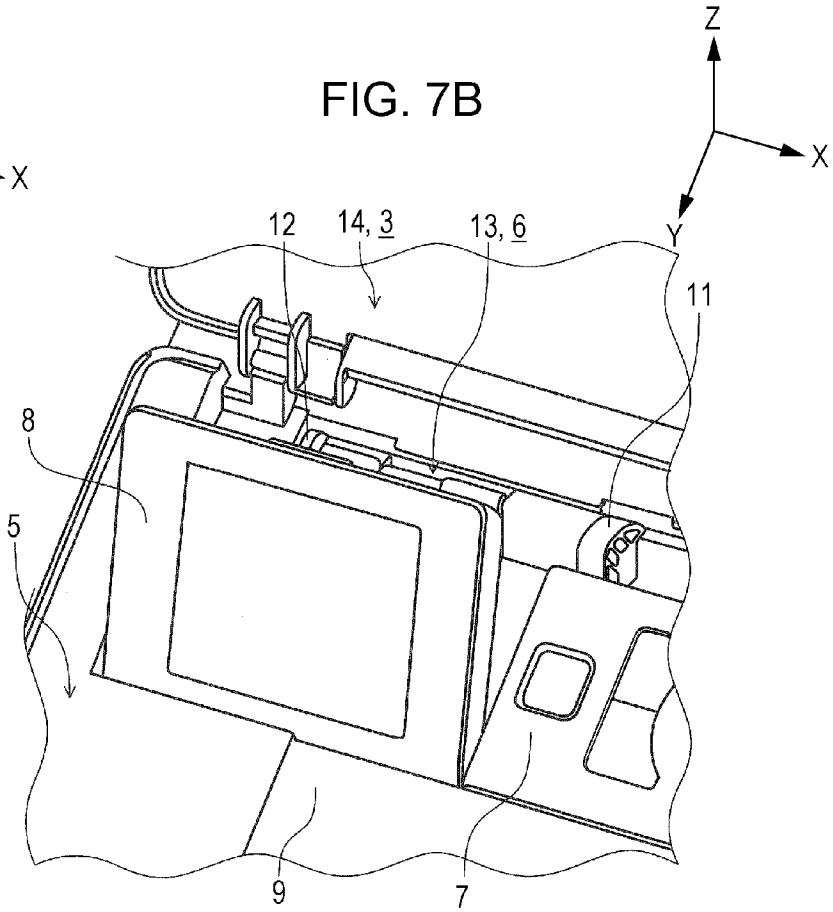
FIGS. 7A and 7B are main part enlarged views of the recording apparatus illustrated in FIG. 2.
Figure 7A:
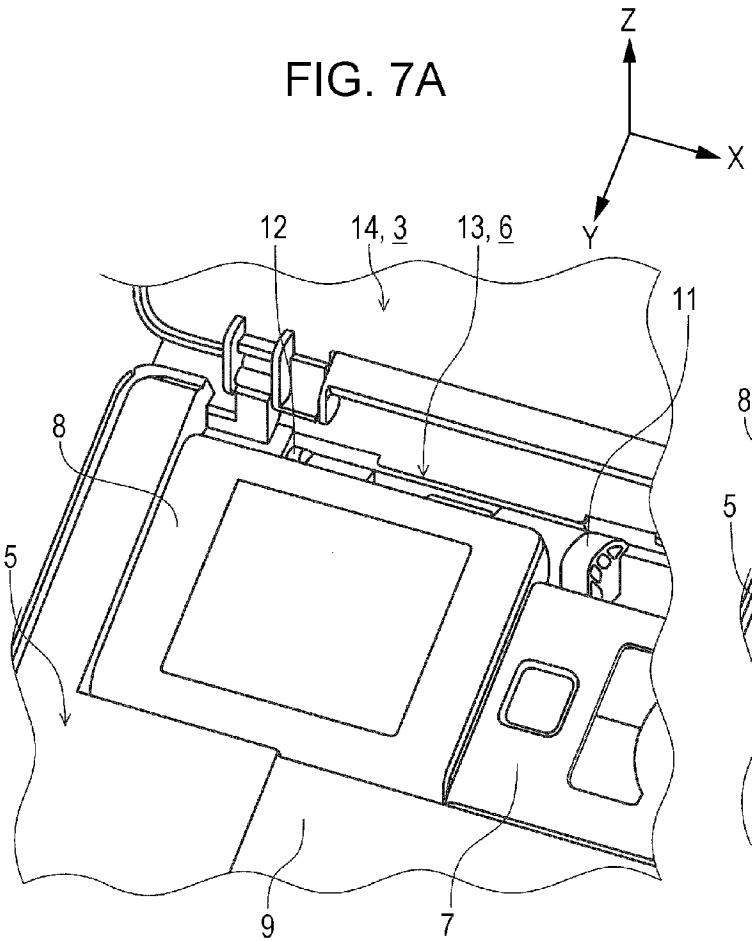

Next, a panel unit will be described which is disposed on the upper surface section 5 of the main body 2 and has various functions. FIGS. 7A and 7B are main part enlarged views of the recording apparatus 1 illustrated in FIG. 2. FIG. 7A illustrates a state where a liquid crystal display is retracted, and FIG. 7B illustrates a state where the liquid crystal display is lifted up.

A liquid crystal display 8 serving as the panel unit having a predetermined function is disposed in the upper surface section 5 of the main body 2. The liquid crystal display 8 is for displaying various information items such as menus and errors. In addition, an operation panel 7 having operation buttons arranged thereon is disposed as the panel unit having another function.

Here, the liquid crystal display 8 serving as one panel unit is disposed so as to overlap a portion of the opening 13 in the outside region of the operation region R of the first edge guide unit 11. In other words, the first edge guide unit 11 is disposed to be movable in a region (operation region R) where the liquid crystal display 8 does not overlap the opening 13.

In FIGS. 7A and 7B, the first edge guide unit 11 is in a state of being located at the position of X2 in FIG. 6C and being located on the side closest to the second edge guide unit 12 in the operation region R. In FIGS. 7A and 7B, the left side (−X side) from the first edge guide unit 11 represents the outside region of the operation region R.

The liquid crystal display 8 is configured to be tiltable so that a screen thereof is lifted up to the front surface side (+Y side) of the recording apparatus 1 (refer to FIG. 7B). Then, the liquid crystal display 8 is configured to overlap the opening 13 in a state where the liquid crystal display 8 is retracted (refer to FIG. 7A).

In this manner, the liquid crystal display 8 can be arranged by further saving an arrangement space in the depth direction (Y-axis direction) of the recording apparatus 1, thereby enabling the recording apparatus 1 to be miniaturized.

In this case, the operation region R of the first edge guide unit 11 is a region where the liquid crystal display 8 does not overlap the opening 13. Accordingly, there is no possibility that operability of the first edge guide unit 11 may be degraded by the liquid crystal display 8 overlapping the opening 13. In addition, even in a state where the tiltable liquid crystal display 8 is lifted up, there is no possibility that the first edge guide unit 11 may be hardly visible.

Figure 9:
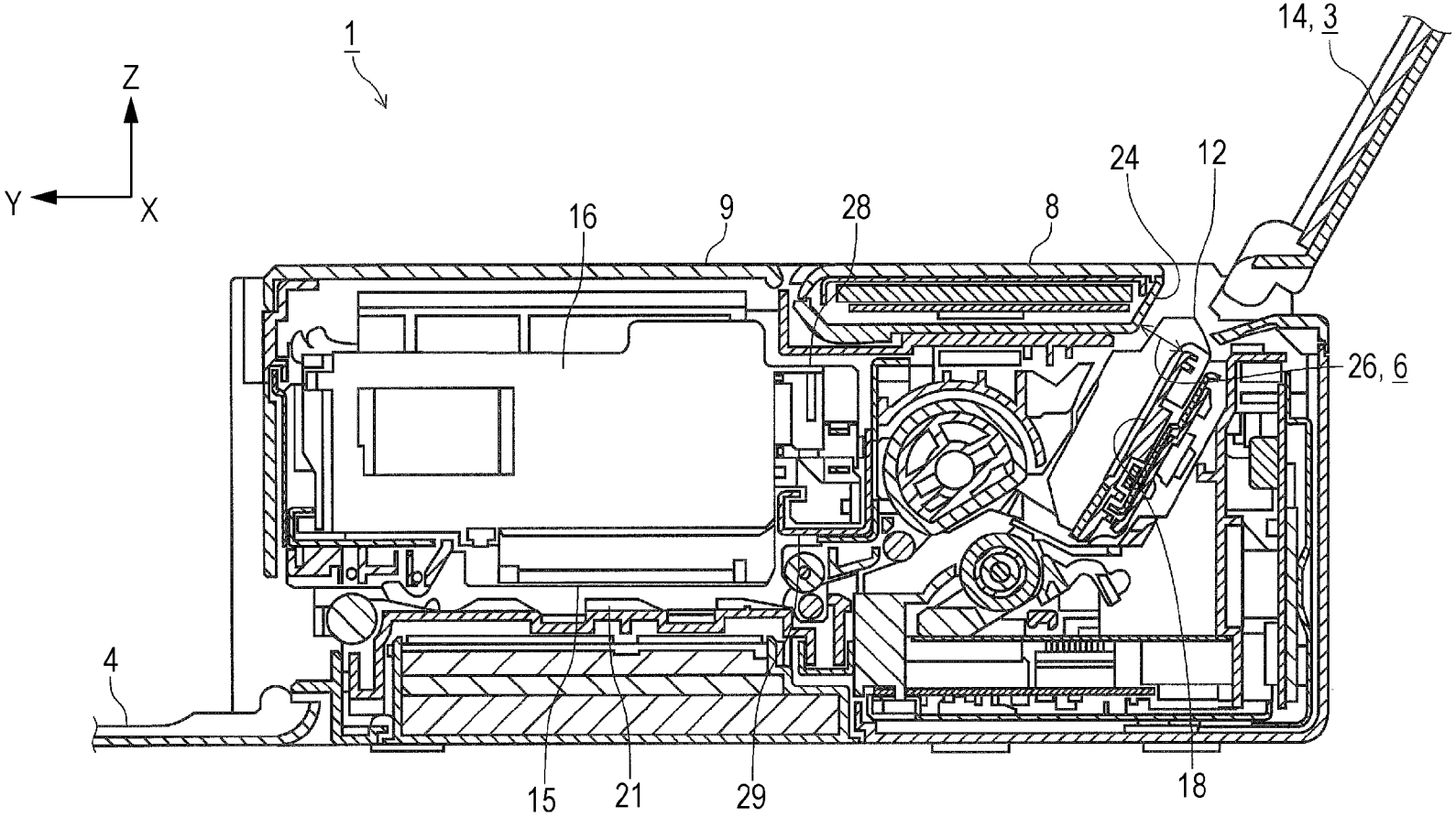
FIG. 9 is a cross-sectional view taken along arrow line IX-IX of the recording apparatus illustrated in FIG. 3.

Furthermore, the liquid crystal display 8 is configured so that a tilted surface 24 illustrated in FIGS. 4 and 9 is formed in a portion of overlapping the opening 13. The tilted surface 24 is formed so as to oppose the placement surface 18 in which the medium P is placed on the medium setting unit 6. FIG. 9 is a cross-sectional view taken along arrow line IX-IX of the recording apparatus 1 illustrated in FIG. 3.

Figure 10:
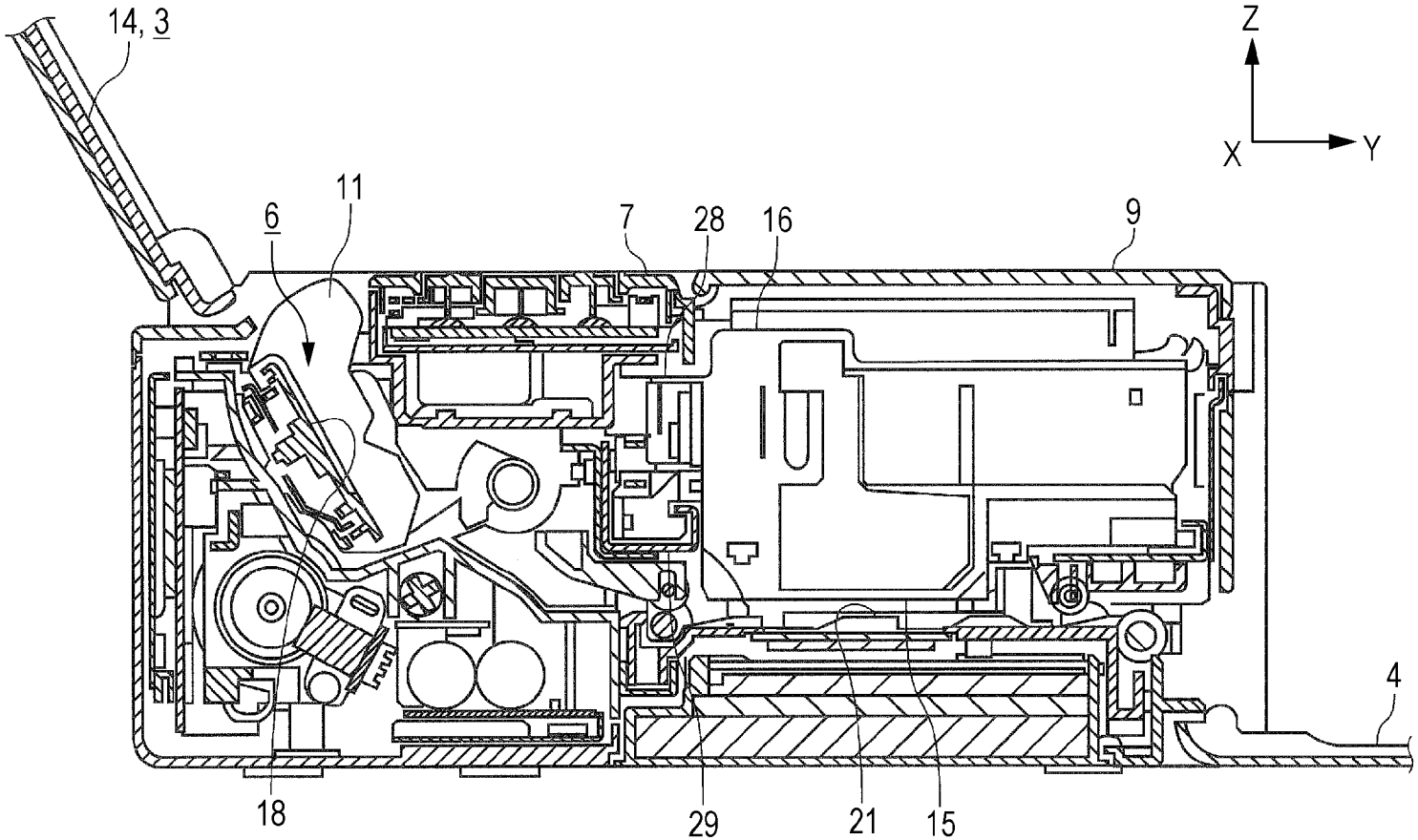
FIG. 10 is a cross-sectional view taken along arrow line X-X of the recording apparatus illustrated in FIG. 3.

The liquid crystal display 8 overlaps the opening 13 of the medium setting unit 6. Accordingly, a space for placing the medium P is further narrowed as compared to a case where the rear surface side (opposite side to the upper surface section 5) of the liquid crystal display 8 protrudes to the placement surface 18 of the medium P in the medium setting unit 6 and the liquid crystal display 8 does not overlap the opening 13 (for example, a case where the operation panel 7 is disposed at a position of not overlapping the opening 13 as illustrated in FIG. 10). FIG. 10 is a cross-sectional view taken along arrow line X-X of the recording apparatus 1 illustrated in FIG. 3.

Since the tilted surface 24 is disposed therein, the placement surface 18 of the medium P and the rear surface side of the liquid crystal display 8 opposing the placement surface 18 can be arranged substantially in parallel with each other. Accordingly, it is possible to easily secure a space 26 for setting the medium P between the placement surface 18 and the liquid crystal display 8. In the recording apparatus 1 according to the embodiment, a distance (corresponding to the space 26) is set between the placement surface 18 and the tilted surface 24 so that a predetermined maximum number of sheets can be placed on the medium setting unit 6 depending on a type of the medium P in a state where the liquid crystal display 8 is retracted.

In the description, the term of parallel does not mean that the placement surface 18 and the tilted surface 24 are strictly in parallel with each other by being tilted at exactly the same angle, and may mean that the placement surface 18 and the tilted surface 24 are substantially in parallel with each other in the medium setting unit 6 so that a section therebetween does not rapidly narrow.

Furthermore, the upper surface cover 3 supporting the medium P on the support surface 14 in an open state is configured so that the support surface 14 extends along the tilt of the tilted surface 24 of the liquid crystal display 8. In this manner, the support surface 14 and the tilted surface 24 can also be arranged substantially in parallel with each other as described above. Therefore, it is possible to stably transport the medium P by supporting the medium P using the upper surface cover 3 in an open state.

The liquid crystal display 8 is disposed so as to overlap the stepped portion 28 formed in the carriage 16 in the depth direction (Y-axis direction) of the recording apparatus 1 (refer to FIGS. 4 and 9). In addition, the operation panel 7 is also similarly disposed so as to overlap the stepped portion 28 in the depth direction (refer to FIG. 10). In this way, the panel unit such as the liquid crystal display 8 and the operation panel 7 overlap at least a portion of the stepped portion 28 of the carriage 16. Accordingly, it is possible to further miniaturize the recording apparatus 1 by avoiding an increased size in the depth direction of the recording apparatus 1.

In addition, as illustrated in FIGS. 4, 9, and 10, it is preferable to configure the liquid crystal display 8 to overlap at least a portion of the stepped portion 28 in the height direction (X-axis direction) of the recording apparatus 1. In this manner, it is possible to further miniaturize the recording apparatus 1 by avoiding an increased size in the height direction of the recording apparatus 1.

Figure 8:
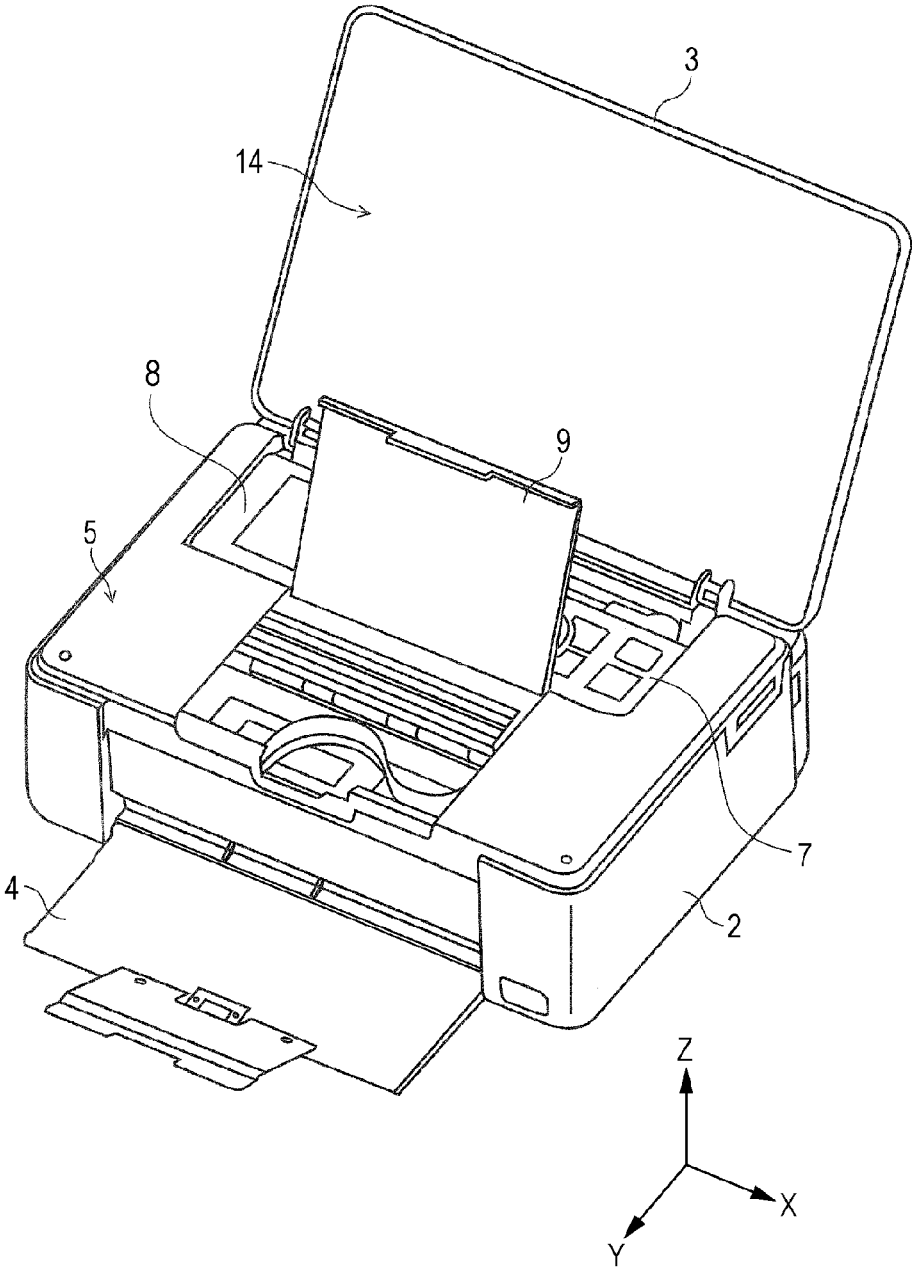
FIG. 8 is a view illustrating a state where a second opening/closing unit is open in the recording apparatus illustrated in FIG. 2.

The upper surface section 5 of the main body 2 includes the opening/closing cover 9 serving as the second opening/closing unit which opens and closes the reciprocating movement region of the carriage inside the main body 2. FIG. 8 is a view illustrating a state where the opening/closing cover 9 is open in the recording apparatus 1 illustrated in FIG. 2. In FIG. 8, the carriage (reference numeral 16 in FIG. 4) is positioned at a home position present on the +X side.

The liquid crystal display 8 and the opening/closing cover 9 are arranged to be connected to each other in the depth direction (Y-axis direction) of the recording apparatus 1. In addition, the operation panel 7 and the opening/closing cover 9 are also similarly arranged to be connected to each other in the depth direction. In this manner, it is possible to further miniaturize the recording apparatus 1 by avoiding an increased size in the depth direction of the recording apparatus 1.

Furthermore, it is preferable to configure the liquid crystal display 8 to overlap at least a portion of the opening/closing cover 9 in the height direction (X-axis direction) of the recording apparatus 1. In this manner, it is possible to further miniaturize the recording apparatus 1 by avoiding an increased size in the height direction of the recording apparatus 1.

It is desirable to dispose the first edge guide unit 11 operated by a user with the user's hand on the right side (right side in FIG. 3) when viewed from the downstream side in the transport direction of the medium P. In this manner, it is possible to adopt a configuration which enables a right-handed user to easily operate the first edge guide unit 11.

In this case, the liquid crystal display 8 is disposed on the left side of the operation region R of the first edge guide unit 11. Accordingly, it is possible to decreases a possibility that a screen on the liquid crystal display 8 may be hidden and hardly visible by the user's hand when the first edge guide unit 11 is operated with the user's hand.

It is desirable to form the second edge guide unit 12 to be smaller than the first edge guide unit 11.

The first edge guide unit 11 on the right side is moved by the user with the user's hand, and thus is formed to have a size which enables the user to easily operate the first edge guide unit 11 with the user's hand. On the other hand, as described above, the second edge guide unit 12 is not disposed on the assumption of the user's operation with the user's hand (for example, refer to FIG. 5). Therefore, as long as the size required for guiding the medium P is sufficiently provide, it is possible to form the second edge guide unit 12 to be smaller than the first edge guide unit 11.

Here, the second edge guide unit 12 is located on the side opposing the first edge guide unit 11, and is located in the outside region of the operation region R of the first edge guide unit 11. Accordingly, in some cases, the second edge guide unit 12 is positioned below the liquid crystal display 8 overlapping the opening 13.

Since the second edge guide unit 12 is formed to be smaller than the first edge guide unit 11, it is possible to configure the second edge guide unit 12 so as not to interfere with the liquid crystal display 8 in the height direction. In addition, a user is less likely to operate the second edge guide unit 12 whose size is small. Therefore, it is possible to minimize a possibility that the user may erroneously operate the second edge guide unit 12.

In the embodiment, a case has been described where the liquid crystal display 8 is disposed so as to overlap the opening 13 of the medium guide unit 6. However, as a matter of course, a configuration can be adopted where another panel unit such as the operation panel 7 overlaps the opening 13. In addition, multiple panel units may be disposed so as to overlap the opening 13.

The medium guide unit 6 into which the medium P is inserted and the panel unit such as the liquid crystal display 8 are not limited to a case of being arranged on the upper surface section 5 side of the recording apparatus 1, and for example, may adopt a configuration of being disposed in a lateral surface section such as a front surface of the apparatus.

In the embodiment, the second edge guide unit 12 is configured to be synchronized with the movement for moving the first edge guide unit 11 with the user's hand by using the rack pinion mechanism. However, a configuration can be adopted where the second edge guide unit 12 is fixed and only the first edge guide unit 11 is moved.

A configuration may be adopted where a user operates both the first edge guide unit 11 and the second edge guide unit 12. In this case, the panel unit such as the liquid crystal display 8 is configured to overlap the opening 13 in a region between both of the edge guide units, that is, in the operation region R on the first edge guide unit 11 side and a region separated from the operation region R on the second edge guide unit 12 side.

In the present embodiment, a configuration is adopted where the first edge guide unit 11 on the right side of the apparatus is operated by a user with the user's hand and the second edge guide unit 12 on the left side of the apparatus is moved in synchronization with the user's operation by using the rack pinion mechanism. However, the configuration may be made reversely.

Without disposing the second edge guide unit 12, the recording apparatus 1 may include only the first edge guide unit 11. In this case, a configuration can be adopted where the edge portion of the medium P is guided by a side wall on the side opposing the first edge guide unit 11 of the opening 13.

According to the recording apparatus 1 in the above-described embodiment, the liquid crystal display 8 serving as the panel unit is disposed so as to overlap a portion of the opening 13 of the medium guide unit 6. In this manner, it is possible to provide a compact and portable recording apparatus 1.

In this case, the operation region R of the first edge guide unit 11 is disposed in a region where the liquid crystal display 8 does not overlap the opening 13. Accordingly, the liquid crystal display 8 overlapping the opening 13 does not interfere with the operation of the first edge guide unit 11. Therefore, even in a state where the tiltable liquid crystal display 8 is retracted, or even in a state where the tiltable liquid crystal display 8 is lifted up, the first edge guide unit 11 is easily operated.

It is possible to decreases a possibility that a screen on the liquid crystal display 8 may be hidden and hardly visible due to a user's hand when the first edge guide unit 11 is operated by the user. Accordingly, it is possible to provide a recording apparatus 1 having excellent operability and convenience when the first edge guide unit 11 is used.

Another Configuration of Recording Apparatus according to Invention

As described above, the recording apparatus 1 according to the first embodiment includes the first opening/closing unit which supports the medium set by the medium setting unit, and adopts a configuration where a single sheet is set by the medium setting unit. However, the invention can also be applied to the recording apparatus which performs recording on a rolled sheet.

Figure 11:
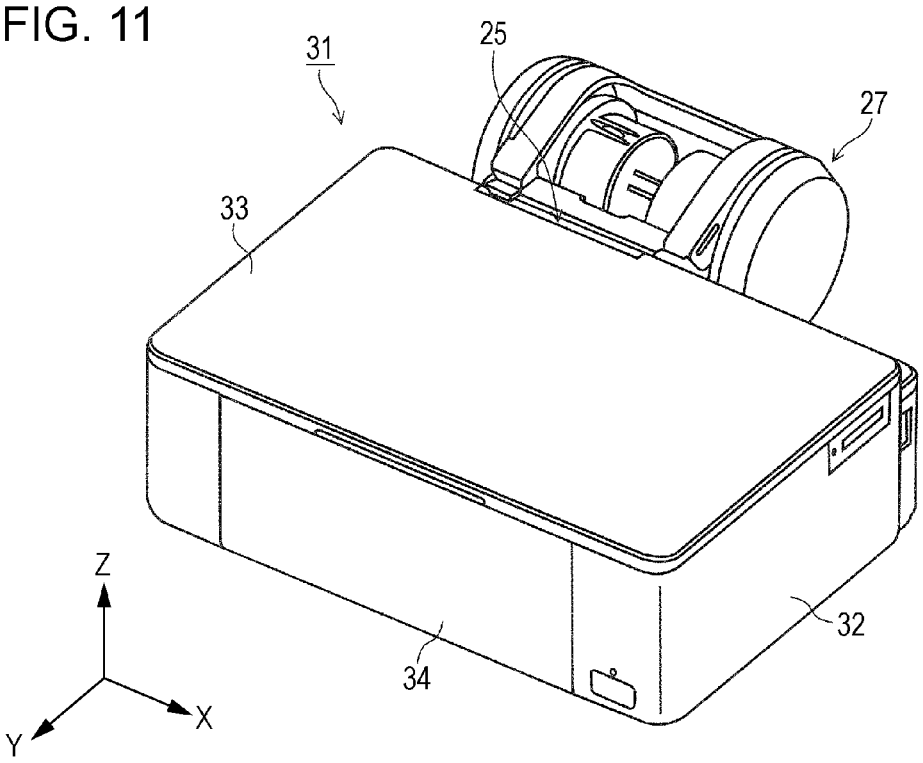
FIG. 11 is a perspective view of a recording apparatus according to another embodiment of the invention.
Figure 12:
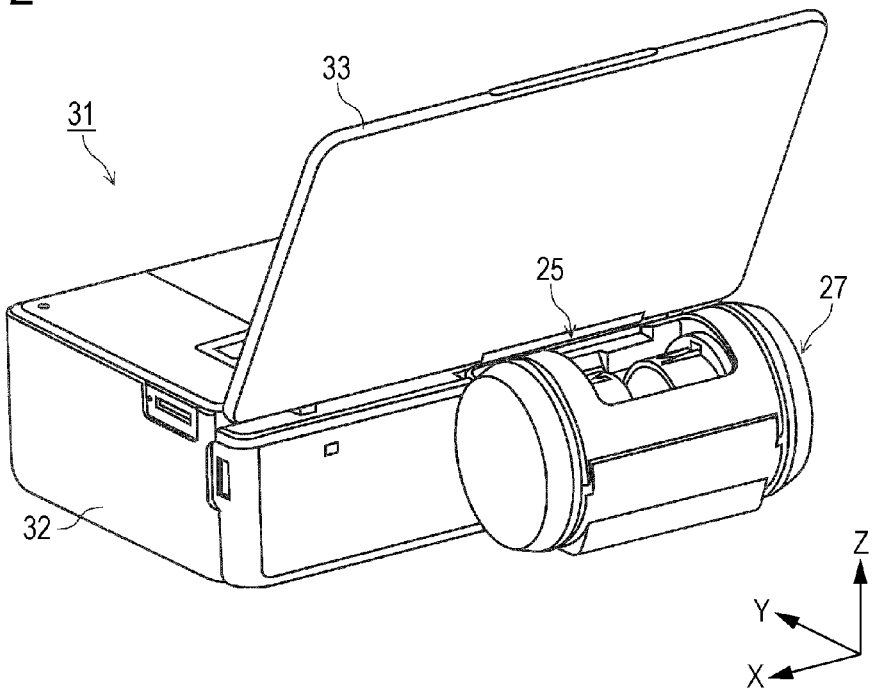
FIG. 12 is a perspective view when the recording apparatus of FIG. 10 in a state where an upper surface cover is open is viewed from a rear surface side.

FIG. 11 is a perspective view illustrating a recording apparatus according to another embodiment of the invention. FIG. 12 is a perspective view when the recording apparatus of FIG. 11 in a state where an upper surface cover is open is viewed from the rear surface side.

A recording apparatus 31 illustrated in FIGS. 11 and 12 is configured to externally include a main body 32, an upper surface cover 33, and a sheet discharge cover 34. In the recording apparatus 31, a configuration on the upper surface section side is the same as that of the recording apparatus 1 according to the first embodiment. Accordingly, hereinafter, when other members which are not illustrated in FIGS. 11 and 12 are described, the description will be made by giving the corresponding reference numerals as in the recording apparatus 1.

The recording apparatus 31 illustrated in FIGS. 11 and 12 adopts a configuration where recording can be performed on a rolled sheet (not illustrated) by supplying the rolled sheet to the opening 13 of the medium setting unit 6 from the rear surface side of the main body 32 of the recording apparatus 31, that is, from a rolled sheet unit 27 disposed on the upstream side (−Y side) in the medium transport direction of the medium setting unit 6.

A configuration is adopted where the rolled sheet is accommodated inside the rolled sheet unit 27, one edge side of the roller sheet is inserted into an insertion port 25 disposed in the upper surface cover 33, and the rolled sheet is set by the medium setting unit 6. The insertion port 25 can guide the rolled sheet, and can set the rolled sheet in the medium setting unit 6.

In the rolled sheet set by the medium setting unit 6, a lateral edge portion in the width direction is further guided by the first edge guide unit 11 and the second edge guide unit 12. Therefore, the rolled sheet can be set and printed in a state where the panel unit is retracted.

In this case, similarly to the first embodiment, the liquid crystal display 8 serving as the panel unit is disposed to overlap a portion of the opening 13 of the medium guide unit 6. Accordingly, as compared to a case where the liquid crystal display 8 does not overlap the portion of the opening 13, it is possible to miniaturize the recording apparatus 31.

A region where the panel unit such as the liquid crystal display 8 does not overlap the opening 13 is the operation region R of the first edge guide unit 11. Accordingly, it is possible to provide a recording apparatus 31 having excellent operability and convenience when the first edge guide unit 11 is used.

Without being limited to the above-described embodiments, the invention can be modified in various ways within the scope of the invention. As a matter of course, the modifications are also included in the scope of the invention.

The entire disclosure of Japanese Patent Application No. 2014-082552, filed Apr. 14, 2014 is expressly incorporated by reference herein.

What is claimed is:

1. A recording apparatus comprising:

a carriage that includes a recording head which performs recording on a medium, and that reciprocates in a predetermined direction;

a display panel that has a predetermined display function and tilts between a state where the display panel is retracted and a state where the display panel is lifted up;

a medium setting unit that has an opening into which a transported medium is inserted, and wherein the display panel is disposed between a moving region of the carriage and the opening of the medium setting unit, and wherein the display panel overlaps at least a portion of the carriage in a height direction of the recording apparatus when the display panel is retracted.

2. The recording apparatus according to claim 1, wherein at least a portion of the carriage overlaps the display panel in a depth direction from a front surface side to a rear surface side of the recording apparatus.

3. The recording apparatus according to claim 1, further comprising:

a stepped portion that is formed in the carriage, wherein the stepped portion and the display panel are adjacent to each other, and the display panel overlaps the stepped portion in at least any one of the height direction of the recording apparatus and the depth direction from the front surface side to the rear surface side of the recording apparatus.

4. The recording apparatus according to claim 1, wherein the display panel overlaps a portion of the opening in the state where the display panel is retracted.

5. The recording apparatus according to claim 1, comprising:

an opening/closing unit that opens and closes a reciprocating movement region of the carriage, wherein the display panel and the opening/closing unit are arranged so as to be connected to each other in a depth direction of the recording apparatus.

6. A recording apparatus comprising:

a carriage that includes a recording head which performs recording on a medium, and that reciprocates in a predetermined direction;

an operation panel that has a predetermined operation function and tilts between a state where a display panel is retracted and a state where the display panel is lifted up, a medium setting unit that has an opening into which a transported medium is inserted, and wherein the operation panel is disposed between a moving region of the carriage and the opening of the medium setting unit, and wherein the operation panel overlaps at least a portion of the carriage in a height direction of the recording apparatus when the display panel is retracted.

7. The recording apparatus according to claim 6, wherein at least a portion of the carriage overlaps the operation panel in a depth direction from a front surface side to a rear surface side of the recording apparatus.

8. The recording apparatus according to claim 6, further comprising:

a stepped portion that is formed in the carriage, wherein the stepped portion and the operation panel are adjacent to each other, and the operation panel overlaps the stepped portion in at least any one of the height direction of the recording apparatus and the depth direction from the front surface side to the rear surface side of the recording apparatus.

9. The recording apparatus according to claim 6, comprising:

an opening/closing unit that opens and closes a reciprocating movement region of the carriage, wherein the operation panel and the opening/closing unit are arranged so as to be connected to each other in a depth direction of the recording apparatus.

10. A recording apparatus comprising:

a carriage that includes a recording head which performs recording on a medium, and that reciprocates in a predetermined direction;

a display panel that has a predetermined display function;

a medium setting unit that has an opening into which a transported medium is inserted; and a first edge guide unit that guides an edge portion of the medium set by the medium setting unit, wherein the carriage and the display panel are adjacent to each other, and the display panel overlaps at least a portion of the carriage in a height direction of the recording apparatus, and wherein the first edge guide unit is movable in a region where the display panel and the opening do not overlap each other.

11. The recording apparatus according to claim 10, wherein the display panel has a tilted surface opposing a placement surface on which the medium is placed in the medium setting unit.

12. The recording apparatus according to claim 11, further comprising:

a first opening/closing unit that opens and closes the opening of at least the medium setting unit, and that supports the medium set by the medium setting unit in an open state, wherein a medium support surface of the first opening/closing unit in the open state extends along a tilt of the tilted surface of the display panel.

13. The recording apparatus according to claim 12, comprising:

a second opening/closing unit that opens and closes a reciprocating movement region of the carriage, wherein the display panel and the second opening/closing unit are arranged so as to be connected to each other in a depth direction of the recording apparatus.

14. The recording apparatus according to claim 10, wherein a roll-shaped medium can be fed to the opening in a state where the display panel overlaps the opening.

15. The recording apparatus according to claim 10, further comprising:

a second edge guide unit that opposes the first edge guide unit, wherein the first edge guide unit is disposed on the right side when viewed from a downstream side in a transport direction of the medium, and wherein a distance between the edge guide units is changed by operating the first edge guide unit.

16. A recording apparatus comprising:

a carriage that includes a recording head which performs recording on a medium, and that reciprocates in a predetermined direction;

an operation panel that has a predetermined display function;

a medium setting unit that has an opening into which a transported medium is inserted; and a first edge guide unit that guides an edge portion of the medium set by the medium setting unit, wherein the carriage and the operation panel are adjacent to each other, and the operation panel overlaps at least a portion of the carriage in a height direction of the recording apparatus, and wherein the first edge guide unit is movable in a region where the operation panel and the opening do not overlap each other.

17. The recording apparatus according to claim 16, wherein the operation panel has a tilted surface opposing a placement surface on which the medium is placed in the medium setting unit.

18. The recording apparatus according to claim 17, further comprising:

a first opening/closing unit that opens and closes the opening of at least the medium setting unit, and that supports the medium set by the medium setting unit in an open state, wherein a medium support surface of the first opening/closing unit in the open state extends along a tilt of the tilted surface of the operation panel.

19. The recording apparatus according to claim 18, comprising:

a second opening/closing unit that opens and closes a reciprocating movement region of the carriage, wherein the operation panel and the second opening/closing unit are arranged so as to be connected to each other in a depth direction of the recording apparatus.

20. The recording apparatus according to claim 16, wherein a roll-shaped medium can be fed to the opening in a state where the operation panel overlaps the opening.

* * * * *